US005657985A

United States Patent [19]

Dahlström et al.

[11] Patent Number: 5,657,985

[45] Date of Patent: Aug. 19, 1997

[54] HANDLE FOR SPORTS EQUIPMENT

[76] Inventors: Christer Dahlström, Sveningshagen 32, S-554 46 Jönköping, Sweden; Thorulf Löfstedt, Forsgatan 1B, S-554 47 Jönköping, Sweden

[21] Appl. No.: 428,181

[22] PCT Filed: Oct. 26, 1993

[86] PCT No.: PCT/SE93/00875

§ 371 Date: Jul. 17, 1995

§ 102(e) Date: Jul. 17, 1995

[87] PCT Pub. No.: WO94/09864

PCT Pub. Date: May 11, 1994

[30] Foreign Application Priority Data

Nov. 3, 1992 [SE] Sweden ..... 9203249

[51] Int. Cl.[6] ..... A63B 49/08

[52] U.S. Cl. ..... 473/523; 473/551

[58] Field of Search ..... 273/73 R, 73 J, 273/75, 81 R, 81.2, 81.4, 81 B

[56] References Cited

U.S. PATENT DOCUMENTS

| | | | |
|---|---|---|---|
| 1,638,454 | 8/1927 | Papin | 273/81.4 |
| 2,280,382 | 4/1942 | Davis | 273/75 |
| 3,868,110 | 2/1975 | Jones | 273/75 |
| 4,511,147 | 4/1985 | Olsen | 273/81.4 X |
| 4,836,544 | 6/1989 | Lai | 273/81.4 X |

FOREIGN PATENT DOCUMENTS

| | | | |
|---|---|---|---|
| 2366106 | 4/1978 | France | 273/75 |
| 2928995 | 4/1981 | Germany | 273/75 |
| 3211428 | 10/1983 | Germany | 273/73 J |
| 229103 | 2/1925 | United Kingdom | 273/81.4 |
| 407270 | 3/1934 | United Kingdom | 273/75 |
| 8702899 | 5/1987 | WIPO | 273/81.4 |

*Primary Examiner*—William E. Stoll

*Attorney, Agent, or Firm*—Burns, Doane, Swecker & Mathis, L.L.P.

[57] ABSTRACT

A racket handle for a racket includes grooves for positioning a player's fingers in a position specifically adapted to the stroke to be performed, and to increase the contact surface between the player's fingers and the racket handle while also assisting the player in teaming a correct grip and stroke. In one embodiment, three index finger grooves are provided in from of a thumb groove. Each index finger groove corresponds to a position of the index finger during a different type of stroke, such as a forehand stroke, a volleying stroke, and a backhand stroke. The thumb groove is also positioned obliquely opposite and adjacent to a middle finger groove to permit the thumb and middle finger to be in contact with one another to form a lock ring around the racket handle.

9 Claims, 6 Drawing Sheets

Fig. 1
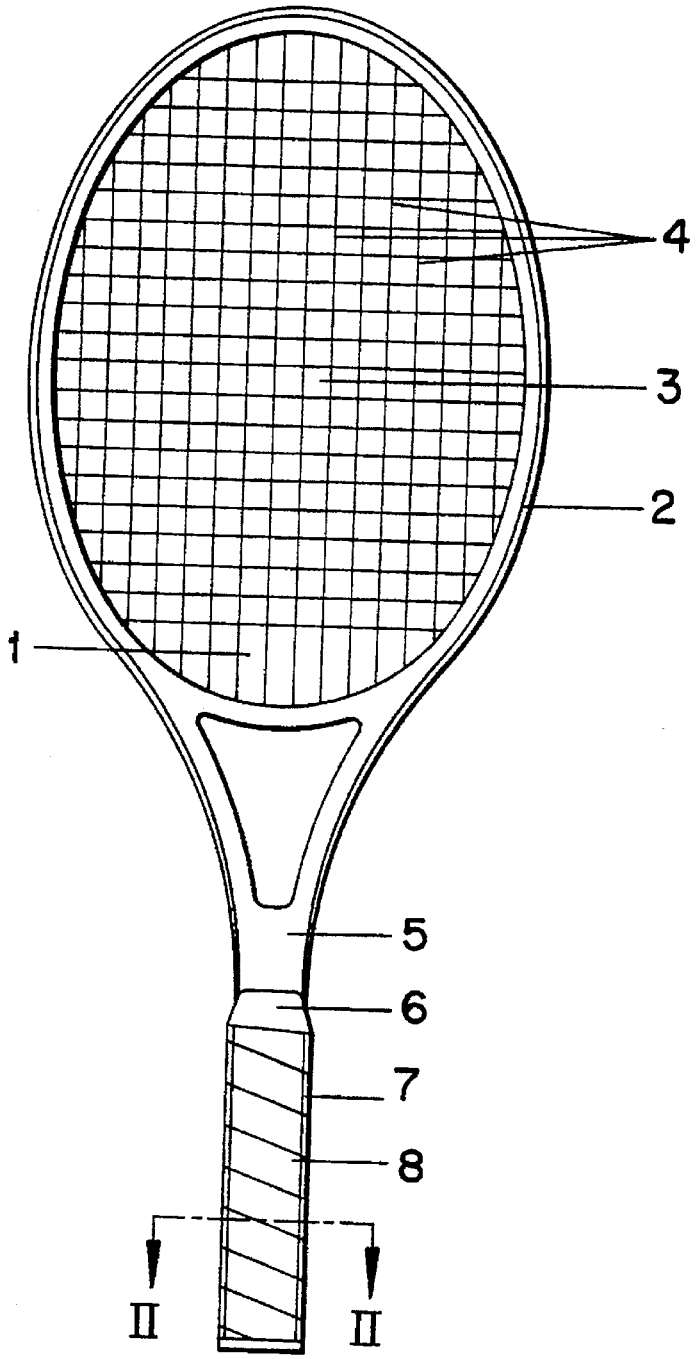
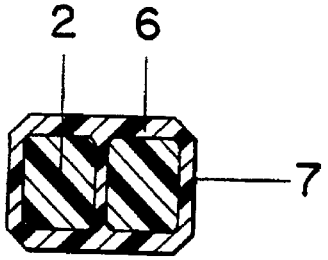
Fig. 2

Fig. 3a
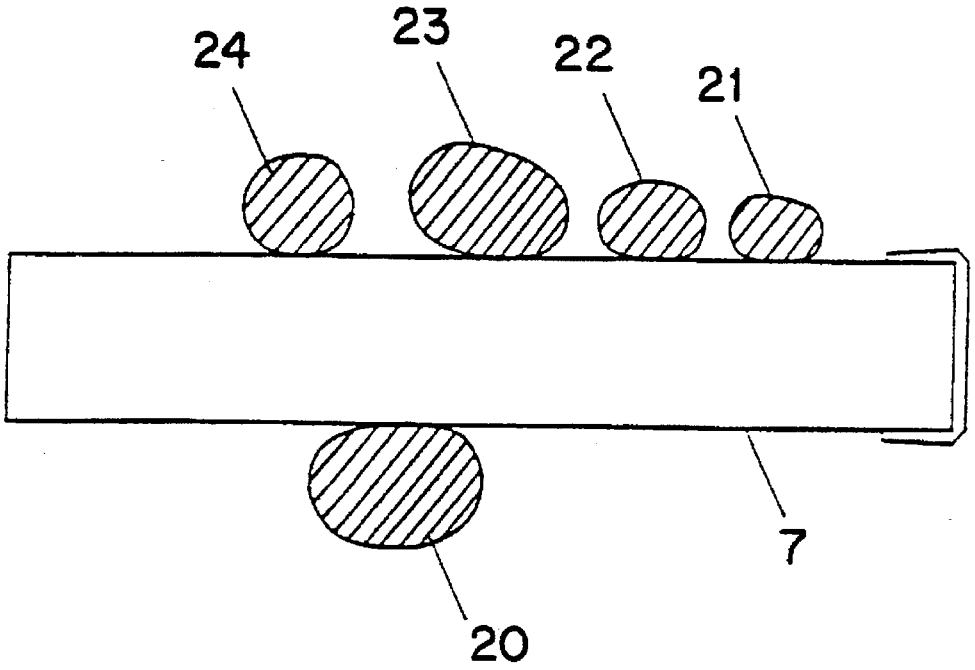
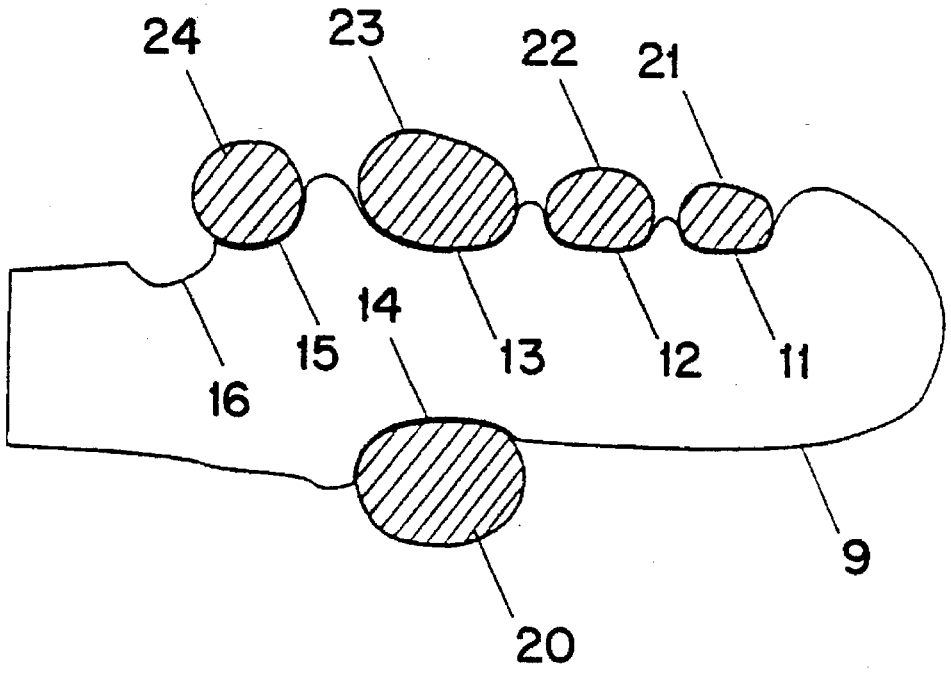
Fig. 3b

Fig. 4
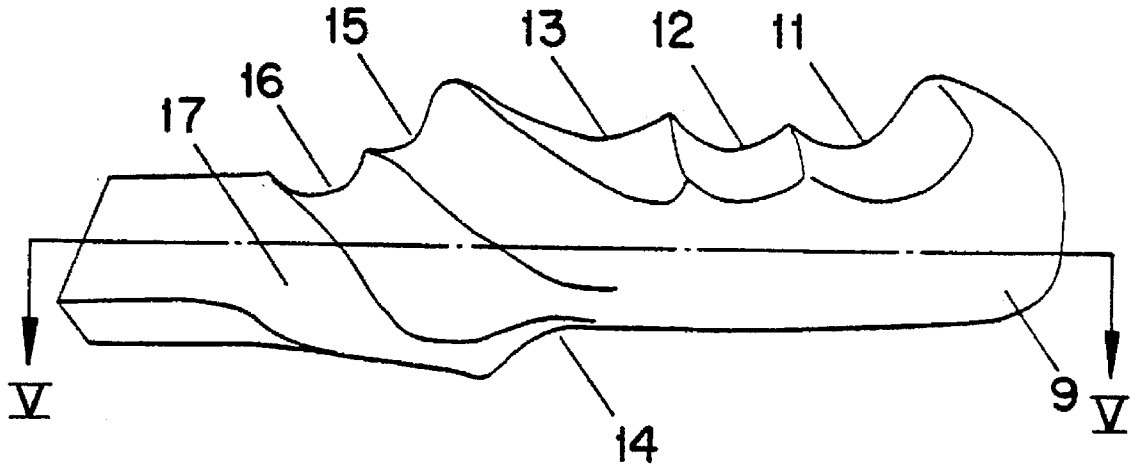
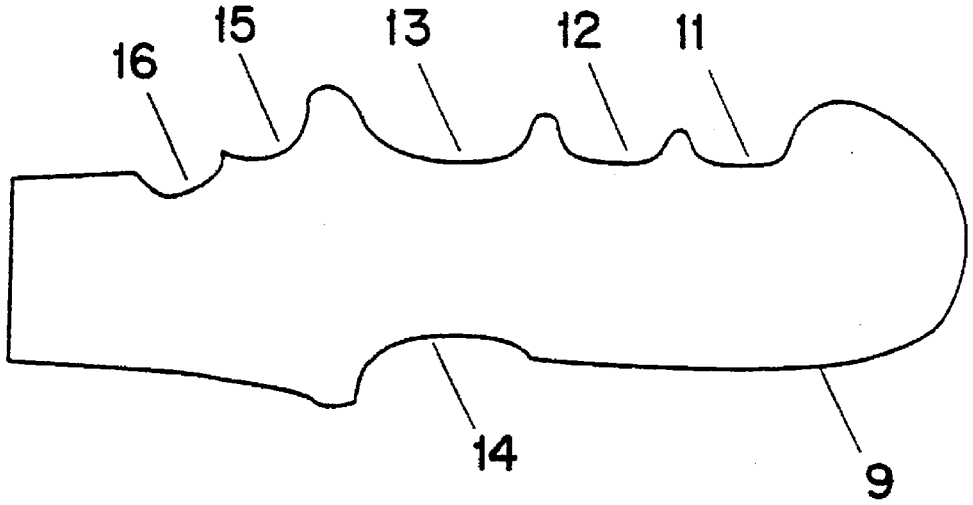
Fig. 5

HANDLE FOR SPORTS EQUIPMENT

The present invention relates to a handle of the kind defined in the preamble of Claim 1.

The invention is directed to sport implements, preferably implements for ball sports where high demands are placed on the contact, i.e. grip, between hand and implement, more preferably to tennis rackets, badminton rackets, squash rackets, baseball bats and cricket bats, golf clubs and similar implements, although the invention can also be applied advantageously in other fields, such as with tools, for instance, where an ergonomical design of the tool handle can result in significant improvements in efficiency.

Sporting implements have been the subject of highly comprehensive developments and new materials and new designs have made possible sporting results that were earlier considered to be totally unachievable. This applies to practically all fields of sport, for instance pole vaulting, skiing, tennis, golf, etc., and attempts by "old masters" to use their old sporting implements and equipment when making a comeback has resulted in catastrophical failure.

The present invention is described with reference to tennis, although as before mentioned measures that are immediately evident or measures which will be obvious to the skilled person can be applied to practically all racket sports and also other sporting fields and areas.

The game of tennis has become faster and actively more precise, the racket blade has become larger and new materials have been used in the strings, frames and shafts of the tennis rackets. The actual grip around the shaft, however, has not been changed to any great extent and the handle of the tennis racket has in the main the same octagonal shape as in the childhood of tennis.

BACKGROUND ART

Many attempts have been made earlier to improve the handles of tennis rackets and like implements, although the majority of these endeavours have been directed towards producing handles that are custom-built to suit the individual.

U.S. Pat. Nos. 4,696,842, 4,765,856 and 4,785,495 relate to handles for tennis rackets and tools which include ridges and intermediate finger grooves.

U.S. Pat. No. 3,868,110 describes a similar tubular handle which is intended to be fitted to a racket shaft and which has two thumb grooves or recesses which enable the grip on the handle to be changed precisely and simply when switching between forehand and backhand strokes.

According to U.S. Pat. No. 4,147,348, a similar handle is angled at about 32° to the remainder of the shaft so as to provide a pistol grip fitting, and the handle may also be angled at 5° to the blade. The grip is intended to be customer-made from an uncured, soft epoxy resin and is gripped by the individual concerned until the resin has hardened.

DOS 2,746,168 and 3,616,414 describe similar handles and different methods of imparting individuality to the handles by a tennis player gripping around soft, uncured resin with his/her playing hand so as to mould the plastic to the individual grip of the person concerned. The resin is then hardened.

GB-A 2,133,294 relates to a handle which is formed anatomically by two half tubes which are fixed to the shaft.

GB-A 2,169,839 relates to a cricket bat handle provided with finger grooves.

U.S. Pat. No. 1,396,424 relates to similar handles for squash rackets.

BACKGROUND OF THE INVENTION

Connections between different elements are used within the technique to transfer forces in one or the other direction and may be fixed connections, such as a weld or a screw joint, or movable connections in the form of a bearing or a hinge. Similarly, manually used tools and implements are movably and detachably connected to the main body of the implement or tool through the medium of one or more connections or contact surfaces, for instance in the case of a knife or hammer through the medium of a single contact surface, in the case of a scythe through the medium of two contact surfaces, and in the case of a spade through the medium of three contact surfaces, and so on.

A number of different measures can be taken on either side of the contact surface with the intention of improving efficiency and/or reinforcing certain aspects of the tool or implement both on the human side, e.g. wrists can be bandaged, and on the mechanical side, e.g. hammer shafts can be made narrower or thicker, rounded or shaped, or made shorter or longer, etc.

Force transmission at the contact surface, i.e. the grip around the handle, depends on the size and configuration of the contact surface, the friction generated and strength of grip.

The friction generated should not be too slight and neither should it be excessive, but that the hand shall be able to move easily when the grip is loosened.

A larger contact surface will reduce the force required to prevent the handle from slipping in the gripping hand, which is particularly significant when the handle is to be held firmly over long periods of time, for instance in a five-set tennis match, which can take several hours to complete.

The actual contact surface and its configuration is thus highly important to the connection of the hand with the handle but has, to a great extent, been left behind in the configuration and design of sporting implements, where the main emphasis has been placed on the technical/mechanical function of the actual implement and not on its ergonomical design.

Present-day tennis rackets differ considerably from the olden day rackets and the frame and strings of modern rackets are completely different to earlier racket frames and strings, although the racket handle has retained the same octagonal shape.

Craftsmen and artisans earlier spent much time and effort in forming an individual and optimal grip on their respective tools. For instance, a metalworker carpenter would sit and cut and whittle the handle of his hammer until it suited exactly his method of working and his own particular wishes.

As evident from the patent specifications recited in the introduction, many suggestions have been proposed for improving the design of customer-adapted racket handles, although none has proposed a generally usable method suited for mass production purposes.

However, handles for tools and implements are nowadays mass-produced in large numbers in a manner, which prevents the handles being adapted individually, these handles normally beding made of a material which makes it impossible to adapt the handles for individual use subsequent to manufacture.

OBJECTS AND SUMMARY OF THE INVENTION

An object of the present invention is to improve the grip around a handle where a high demand is placed on the contact between hand and implement and the strength of grip.

Another object of the invention is to contribute towards and to maintain a true grip and to facilitate a change of grip in the performance of different types of stroke. A further object is to dampen transmission of vibrations from implement to hand and arm.

Another object of the invention is to reduce the stresses on hand and arm that occur when off-centre hits and strokes which are not perfectly "clean" are made.

Still another of the invention is to produce a handle which has improved properties and which can be mass-produced economically to suit practically all players either directly or after simple adjustment.

BRIEF DESCRIPTION OF THE DRAWINGS

The invention will now be described in more detail with reference to embodiments of a tennis racket and with reference to the accompanying drawings, in which FIG. 1 illustrates a tennis racket comprising a traditional handle;

FIG. 2 is a sectional view of the handle in FIG. 1, taken on the line II—II;

FIG. 3 is a schematic longitudinal sectional view with the fingers shown gripping (a) a traditional handle and (b) an inventive handle;

FIG. 4 is a side view of an inventive handle;

FIG. 5 is a sectional view taken on the line V—V in FIG. 4;

Figure 6:
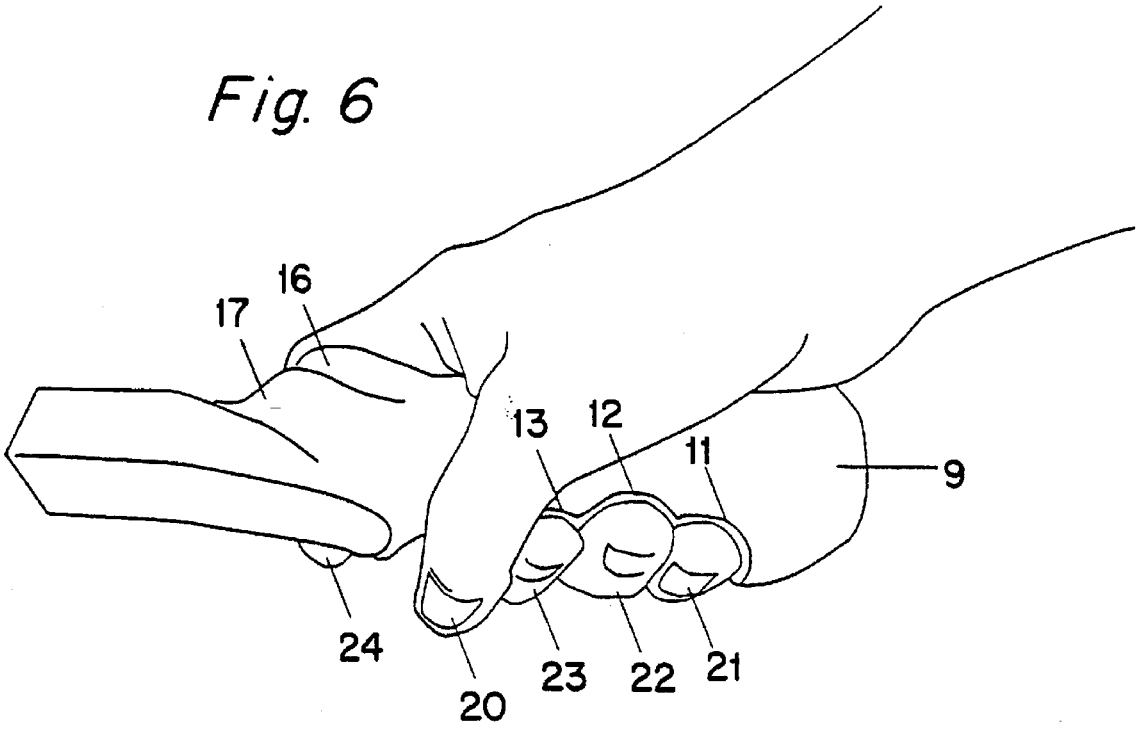
FIG. 6 illustrates the finger position according to the invention for a forehand stroke.
Figure 7:
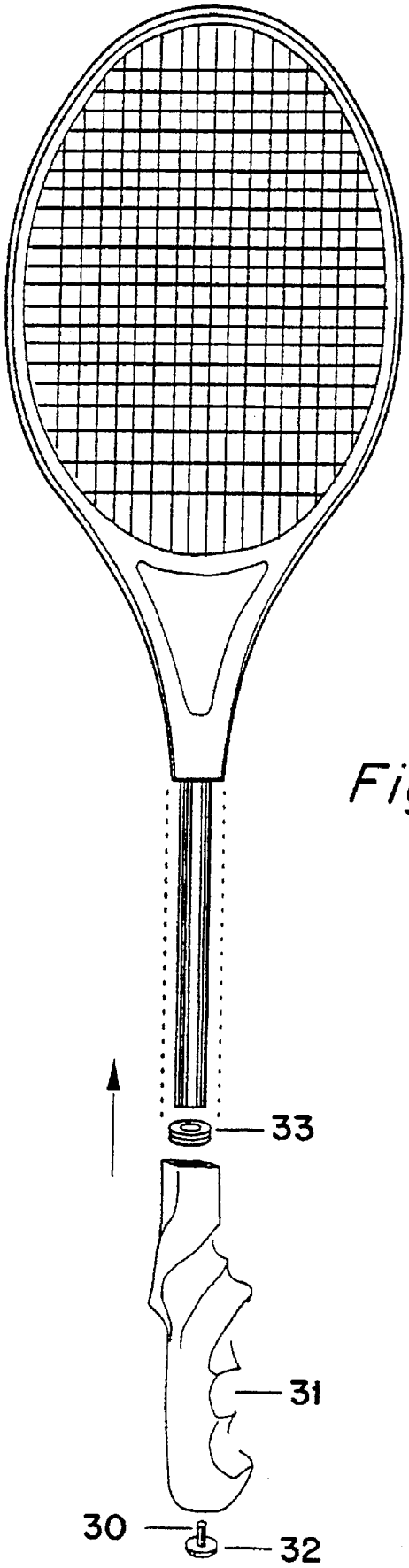
FIG. 7 illustrates a twistable handle attachment according to the invention.

The racket 1 illustrated in FIG. 1 has a frame 2 which is comprised of a rail that has been bent to form a loop or ring around the racket impact surface 3 comprised of strings 4, whereafter the two ends of the loop or ring merge together in a so-called heart-piece of a shaft 6, and are held together by a plastic moulding 7 which forms the handle. The handle is wound with leather 8 along the lower part of the shaft 6.

DETAILED DESCRIPTION OF THE PREFERRED EMBODIMENTS

In the case of a traditional handle, the player's hand grips around an octagonal handle 7 having flat surfaces, as shown in FIG. 2. As illustrated in FIG. 3*a*, the contact surface between handle 7 and fingers is formed solely by the inner surfaces of the fingers.

The inventive handle 9 is provided with grooves 11–17 which are intended to receive the fingers 20–24 of the playing hand. The contemplated schematic cross-sectional views 3*a*, relating to a racket 7 of conventional kind, and 3*b*, relating to an inventive racket 9, illustrate the differences between the contact surfaces. In the first case, the fingers are flattened when gripping the handle and the contact surface is comprised solely of the inner surfaces of the fingers, whereas in the second case, the fingers 20–24 are received in the grooves 11–15 so that the side surfaces of the fingers will function to strengthen the grip. The two empty grooves 16 and 17 will be described in more detail in the following.

Because the abutment surface between fingers and shaft is enlarged, the same grip is achieved with less force.

The finger-wide grooves enlargen the finger abutment surfaces and increase friction, while fixing the finger positions so that the racket will not slide or slip in the gripping hand. We have found that the force required to achieve a firm grip is reduced by about 30%. This can have decisive significance to the outcome of a long tennis match during which tiredness may set in.

Although one and the same handle can normally be used for normal-sized hands, the grooves can be made deeper for extremely small hands and the shaft can be wound and the dimensions of the grooves therewith increased in the case of very large hands.

As before mentioned, the grooves determine and fix the positioning of the fingers, the racket grip, and in order to provide the best stroke effect with the smallest strain on the body it is necessary to change or modify the grip for different strokes. For instance, a backhand stroke which is performed with a forehand grip will place the arm and the elbow under a great deal of strain, because the forces acting in The grip, and therewith on the arm, are directed wrongly. The grip should therefore be changed, at least when the racket is used single handed. In The case of a traditional handle, the racket is therefore twisted in the hand when changing from one stroke to another and the thumb is held constantly more or less in front of the other fingers. In the case of the inventive handle, however, the handle is held firmly without being twisted and the thumb 20 engages between the middle finger 23 and the index finger 24.

It is therefore possible to maintain constantly a firm locking ring formed by of thumb and middle finger around the handle both when executing a forehand and a backhand stroke, which ensures that the racket handle will not twist in the hand while exerting only half the gripping force that is required with a conventional racket to achieve the same effect. The significance of this improved grip, with the double-gripping force, will be readily perceived when considering that tennis balls can be struck at speeds of 160 to 200 km/h. and that when such a ball strikes the racket to one side of blade centre, an off-centre hit, the torque on the racket will be extremely high and that if the grip is not sufficiently firm and strong, the ball will be returned a direction quite different to that intended.

The fixed position of the thumb and the fixed position of the handle in the hand of the player is thus completely different from what is usual at present, where the racket is twisted slightly in the player's hand and the thumb is preferably turned forwards when executing a back stroke. According to the invention, the index finger 24 alternates between three grooves, the groove 15 for a forehand stroke, the groove 16 for a serve, volley and smash, and the groove 17 for the backhand stroke, as shown in FIGS. 4 and 6. As a result of movement of the index finger and as a result of the "locking ring" formed by the thumb 20 and middle finger 23, the grip on the racket is highly stable for all types of stroke and exactly the same from stroke to stroke, as is also the angle of the racket, and the strokes will therefore also be uniform. The index finger can also be moved faster than the racket can be twisted and the thumb moved.

The correct grip, which is a necessity for good tennis, has been difficult to acquire and has often taken a long time and much work to perfect. The traditional handle provides no assistance in this regard. In the case of the inventive handle, however, the grip is automatically correct and better from the beginning and the beginner is able to save many months and perhaps even years in learning game techniques and may even play better than his/her fellow players who have several years training after only a short period of time. Older players who have become accustomed to a given grip on the racket handle and persist with this grip have in many instances improved their game considerably when using a racket that is constructed in accordance with the invention.

The delimitation between the grooves 16 and 17 defines the exact position of the index finger 24 for different strokes, although the extent of this delimitation can be reduced in order to enable the grip to be changed more quickly. According to an alternative embodiment, the two grooves 16 and 17 may be given the form of a single groove with only a small or no delimitation therebetween, while retaining the principle of the invention with the grip in the form of a locking ring. This latter embodiment can also satisfy the requirement of a player for greater flexibility.

As before mentioned, the racket shaft and handle are normally formed by bringing the ends of the frame 2 together so as to form a shaft which is encased in a plastic moulding. The handle is produced by winding a thin plastic material or leather material around the lower part of the shaft, to form the earlier handle 7. The inventive handle 9 may be produced in a similar manner, by moulding the handle simultaneously as a part of the shaft 6 around the ends of the frame rail from similar plastic material, for instance polyurethane, epoxy resin or similar plastics or combinations of plastic materials.

In order to dampen vibrations generated upon impact and to lessen the strains occurring on arms and hands, the handle may be provided with a covering of vibration damping material, such as a suitable elastomeric material or soft plastic material, optionally a porous material, or alternatively a covering of a more elastic material proximal to the shaft and a harder material externally of the more elastic material, using two different plastic materials herefor. In the case of pneumatic tools and machines, various methods have long been used to dampen vibrations by choice of material and the use of material combinations in handles, and similar configurations have also been found to provide good results here. In the case of tennis rackets, the handle is also normally wound with strips of leather or plastic material in order to provide a better grip, to absorb perspiration and also to reduce the transmission of vibrations. According to the present invention, such a winding can assist in filling-out the grooves in the handle, so as to adapt the handle to hands of other sizes, as mentioned in the aforegoing, and to enable handles to be manufactured in only one size, although a mirror image design must be made, of course, for left-handed players.

The so-called two-handed grip is being used increasingly. For players who have a strong liking for the two-handed grip, an additional, mirror-image handle can be provided above the standard handle. One or both of these handles may advantageously be given only a small delimitation between the grooves 16 and 17 or the delimitation may be omitted completely, and/or the handle intended for the "support hand" may be devoid of grooves.

Two-handed handles have been made earlier, although these handles have been designed so that the hands are spaced from one another. According to the invention, however, the inventive handle is configured so that the hands will lie close together, thereby providing greater grip stability.

Figure 8:
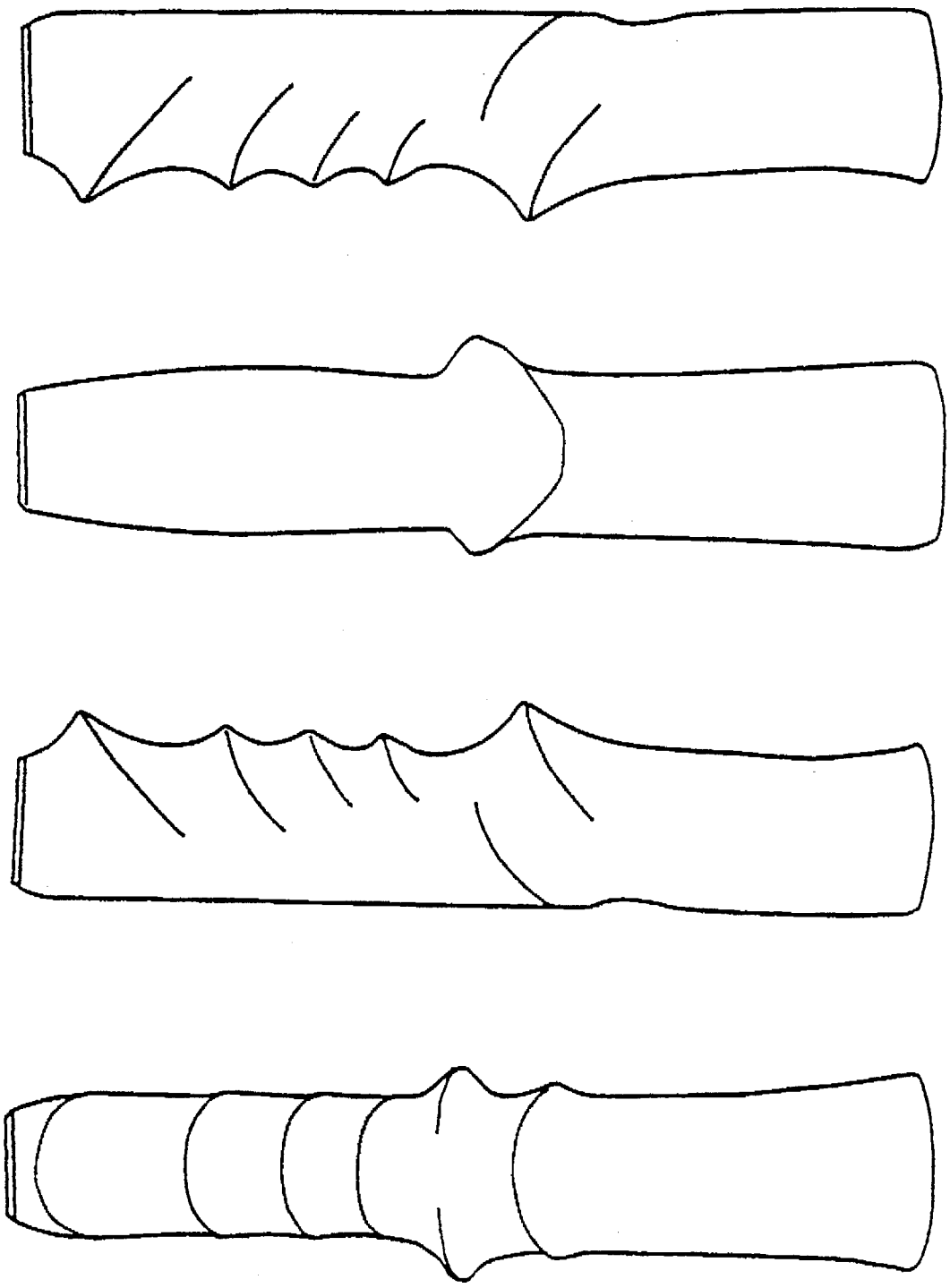
FIG. 8 illustrates an inventive double-grip handle for both right-handed and left-handed players.

An advantageous embodiment of a racket handle that can be used by both right-handed and left-handed players is illustrated in FIG. 8.

The gripping surface of the inventive handle can be given a rugged, serrated or perforated surface in a known manner, in the case of all embodiments.

In the case of a traditional racket, the impact surface is considered to be the most essential part of the racket and the frame terminates in an extended part around the end of which several meters of tape are wound to form a hand grip, a construction in one single part. According to the invention, however, the handle is an equally essential part of the racket, and according to a further development of the invention, the blade is produced separately from the handle and the handle and the shaft are made as a separate and equally valuable unit. In this case, the frame terminates in a screw-threaded pin 30 on which the tubular shaft 31 is placed and firmly locked with a nut 32 on the pin threads. The pin may have a square or hexagonal cross-section or any other cross-sectional shape which will ensure non-rotation of the pin, although the pin will preferably have the form of a spline onto which the shaft can be fitted at different angles, for instance an angle of 5°, as proposed in the prior publication U.S. Pat. No. 4,147,348 earlier mentioned. The length of the shaft can also be varied with the aid of insert washers 33, suitably washers made of a vibration damping material, such as rubber, composites or the like. This combination of shaft length and angular adjustment can be used to adapt the racket to different playing surfaces, such as grass, clay, gavel surfaces, etc.

Detachable handles of this kind can also be used to replace the handles of existing rackets should a player wish to keep his old racket for some particular reason or because of cost. In this regard, either the entire racket shaft may be replaced or only the actual handle, and the join can either be effected with the aid of a peg or a spline or in some other way, for instance by gluing. Similarly, a handle for a two-handed grip can also be built-up advantageously. FIG. 8 illustrates an example of such a construction.

A simple method of providing "conventional" rackets with inventive handles is to fasten elevations corresponding to the ridges on the inventive handle to a thin substrate and then securing the substrate to the racket shaft. The substrate may be comprised of a plastic, elastomeric or natural material. The elevations are glued or moulded onto the substrate, or may be formed integrally therewith from the same material. It is essential that the materials used are sufficiently elastic to be able to adapt exactly to the conventional octagonal racket shaft, either with or without heating the material. The substrate can be secured with the aid of an adhesive and/or by winding strips of leather or plastic or elastomeric material around the substrate, in a known manner.

The attachment of the substrate can be strengthened with the aid of rings around one or both ends. The substrate may be flat or tubular and may also comprise several parts and a vibration-damping layer may be placed between the shaft and the substrate.

The aforedescribed methods may also be applied advantageously in the construction of two-handed grips with double gripping surfaces.

The thickness of the handle is a function of hand size, although the ridges can be polished down to smaller sizes or a thicker winding can be wound around the handle so that one and the same handle will cover the requirements of the majority of players after minor adjustments to suit hand sizes which deviate radically from the average size, and individual handles need only be customer-made with regard to handle measurements in exceptional cases. It is also necessary to produce the handle in accordance with specified measurements when particular requirements are placed on the racket, for instance in the case of professionally highranked players for whom the cost of the racket is unimportant, and also when a very slight change in the properties of the racket are desired.

The present invention results in a grip of substantially greater cross-sectional radius and therewith a higher torque. The risk of the racket slipping from the hand when serving or smashing a ball has been minimized as a result of the special configuration of the index finger groove together with the "locking ring". As opposed to rackets of a conventional design, there is also less reduction in the force with which the racket handle is gripped as the player begins tire in a long tennis match.

The inventive handle has been found to improve the player's game, to enhance the player's clean stroke performance, and to reduce considerably such injuries as tennis arm, joint injuries, back injuries, etc., and greatly assists beginners to quickly learn the technique of tennis stroke play so that he/she will enjoy and maintain his/her game.

Although the invention has been described and illustrated with respect to certain exemplifying embodiments thereof, it will be understood that other embodiments are conceivable within the scope of the invention as defined in the following Claims.

We claim:

1. A racket handle for a racket which possesses a racket impact surface, the racket handle being configured to position fingers of a player's hand in a position specifically adapted to a type of stroke to be performed, and to increase contact surface between the player's fingers and the racket handle while also assisting the player in learning a correct grip and stroke, the racket handle having a forward end to be located closer to the racket impact surface and an oppositely located rearward end, the racket handle comprising: a thumb groove for accommodating a thumb of a player; a rear groove, a center groove, and a front groove each positioned to accommodate an index finger of the player in a position forward of the thumb groove, the rear groove being positioned to accommodate the index finger during a forehand stroke, the center groove being positioned to accommodate the index finger during serving, volleying and smashing strokes, and the front groove being positioned to accommodate the index finger during a backhand stroke; a first single groove for accommodating a middle finger of a player, a second single groove for accommodating a little finger of the player, and a third single groove for accommodating the finger of the player between the middle finger and the little finger, the thumb groove and said first single groove being located obliquely opposite and adjacent one another to permit the thumb and the middle finger to be in contact with one another to form a ring lock around the racket handle.

2. A racket handle according to claim 1, including a delimitation between the center groove and the front groove that is configured to accommodate movement of the index finger between said center and front groove.

3. A handle according to claim 1, including a hand grip region positioned between the rearward end of the handle and the third single finger groove to receive a second hand of the player.

4. A handle according to claim 1, wherein bottom surfaces of at least some of said grooves are elastic to allow the fingers to sink slightly in said bottom surfaces and permit the racket handle to accommodate hands of different sizes.

5. A handle according to claim 1, further comprising means for damping vibration.

6. A handle according to claim 1, wherein said handle includes means for using said handle as a replacement for a traditional racket handle.

7. A racket handle according to claim 1, further comprising:

a tubular opening extending through the handle for receiving a shaft of a racket.

8. A racket handle for a racket which possesses a racket impact surface, the racket handle comprising:

a forward end to be located closer to a racket impact surface and an oppositely located rearward end;

a first index finger groove and a second index finger groove each positioned to accommodate a player's index finger, said first index finger groove positioned and configured to accommodate said index finger during a forehand stroke, said second index finger groove positioned and configured to accommodate two separate and spaced apart positions of said index finger corresponding to a backhand stroke and a serving, volleying, and smashing stroke;

a thumb groove for accommodating the player's thumb, the thumb groove being positioned rearward of said first and second index finger grooves;

a middle finger groove for accommodating the player's middle finger, the middle finger groove being located obliquely opposite and adjacent to said thumb groove to permit the thumb and the middle finger to be in contact with one another to form a ring lock around the racket handle.

9. A racket handle according to claim 8, further comprising a little finger groove for accommodating the player's little finger; a ring finger groove for accommodating the player's finger which is between the player's little finger and middle finger, the little finger groove located rearward of the ring finger groove.

* * * * *